US009944439B2

(12) United States Patent
Lee et al.

(10) Patent No.: US 9,944,439 B2
(45) Date of Patent: Apr. 17, 2018

(54) CONTAINER LID

(71) Applicant: HELEN OF TROY LIMITED, Belleville, St. Michael (BB)

(72) Inventors: Alexander Tze Fung Lee, New York, NY (US); Larry S. Witt, Califon, NJ (US); Michael John Laskowski, Pittsburgh, PA (US); Hyukjae Chang, Pittsburgh, PA (US); Noah Ziman Pentelovitch, New York, NY (US); Ryan Vernon, New York, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 23 days.

(21) Appl. No.: 14/198,800

(22) Filed: Mar. 6, 2014

(65) Prior Publication Data

US 2015/0251826 A1 Sep. 10, 2015

(51) Int. Cl.

| | |
|---|---|
| ***B65D 47/08*** | (2006.01) |
| *B65D 43/20* | (2006.01) |
| *B65D 53/02* | (2006.01) |

(52) U.S. Cl.

CPC ..... *B65D 47/0895* (2013.01); *B65D 43/20* (2013.01); *B65D 53/02* (2013.01); *B65D 2251/205* (2013.01); *B65D 2543/00462* (2013.01); *B65D 2543/00564* (2013.01)

(58) Field of Classification Search

CPC .... B65D 43/18; B65D 43/022; B65D 43/163; B65D 43/166; B65D 43/167; B65D 45/20; B65D 47/065; B65D 47/066; B65D 47/08; B65D 47/088; B65D 47/0885; B65D 47/2006; B65D 47/2012; B65D 2543/00435; B65D 2543/00388; B65D 2543/00564; B65D 2543/00888; B65D 2543/916; B65D 543/00083

See application file for complete search history.

(56) References Cited

U.S. PATENT DOCUMENTS

| | | | | |
|---|---|---|---|---|
| 1,589,872 A | | 6/1926 | Brunhoff | |
| 2,333,117 A | * | 11/1943 | Nyden | 220/282 |
| 2,679,945 A | | 6/1954 | Cahill | |
| 2,926,811 A | * | 3/1960 | Faust | F16J 13/20 220/244 |
| 3,164,306 A | | 1/1965 | Kitterman | |

(Continued)

FOREIGN PATENT DOCUMENTS

| | | |
|---|---|---|
| DE | 19807474 | 8/1999 |
| EP | 0609955 | 10/1994 |

(Continued)

OTHER PUBLICATIONS

International Search Report filed in PCT/US2015/17064 mailed May 29, 2015.

*Primary Examiner* — Anthony Stashick
*Assistant Examiner* — James Way
(74) *Attorney, Agent, or Firm* — Rankin, Hill & Clark LLP

(57) ABSTRACT

A container lid assembly includes a cover, a pivoting lid connected with the cover, and a lid gasket connected with the pivoting lid. The cover is configured to fit with an associated container and defines an opening through the cover. The pivoting lid is positioned in the opening in the cover. The pivoting lid is movable between an open position and a closed position.

22 Claims, 4 Drawing Sheets

(56) References Cited

U.S. PATENT DOCUMENTS

| | | | | | |
|---|---|---|---|---|---|
| 4,047,648 | A * | 9/1977 | Croyle | B65D | 47/0895 220/375 |
| 4,335,828 | A | 6/1982 | Robinson, Jr. et al. | | |
| 4,736,858 | A * | 4/1988 | Shastal | | 215/236 |
| 4,776,501 | A * | 10/1988 | Ostrowsky | | 222/517 |
| 5,086,956 | A * | 2/1992 | Polhemus | | 222/472 |
| 5,533,643 | A * | 7/1996 | Kruzick | | 220/812 |
| 5,918,777 | A * | 7/1999 | Flak | | 222/212 |
| 6,279,788 | B1 | 8/2001 | Lillelund | | |
| 6,554,181 | B1 | 4/2003 | Dammers | | |
| 8,215,514 | B2 * | 7/2012 | Morenstein et al. | | 220/376 |
| 2009/0236373 | A1 * | 9/2009 | Laib et al. | | 222/484 |
| 2010/0108682 | A1 | 5/2010 | Chen | | |
| 2012/0285125 | A1 * | 11/2012 | Bailey | B65D | 43/164 53/492 |

FOREIGN PATENT DOCUMENTS

| | | |
|---|---|---|
| GB | 2250504 | 10/1992 |
| JP | 5306857 | 9/2010 |

* cited by examiner

CONTAINER LID

BACKGROUND

Containers used to store food and other items may include a sealable lid that forms a seal with the container to maintain quality and freshness of the food stored in the container. There are many different types of sealable lids. Some containers include a snap fit or friction fit lid to form a seal with a container. These lids can be difficult to secure to the container. Other lids include latches that engage the container to hold the lid to the container and maintain the seal between the lid and the container. Sometimes these latches can be difficult to operate. Also, for containers where the food is to be poured from the container, it can be difficult to design a lid that can easily open and properly seal against such a container.

SUMMARY

In view of the foregoing, a container lid assembly includes a cover, a pivoting lid connected with the cover, and a lid gasket connected with the pivoting lid. The cover is configured to fit with an associated container and defines an opening through the cover. The pivoting lid is positioned in the opening in the cover. The pivoting lid is movable between an open position and a closed position. The lid gasket defines an upper surface and a lower surface. The upper surface and the lower surface of the lid gasket contacts the cover when the pivoting lid is in the closed position.

Another example of a container lid assembly includes a cover and a pivoting lid connected with the cover. The cover is configured to fit with an associated container and defines an opening through the cover. The pivoting lid is releasably connected with the cover and is positioned in the opening in the cover. The pivoting lid is movable between an open position and a closed position. The pivoting lid is slidably removable from the cover when the pivoting lid is in the open position.

Another example of a container lid assembly includes a cover, a pivoting lid connected with the cover, and a lid gasket connected with the pivoting lid. The cover is configured to fit with an associated container and includes a peripheral wall at least partially defining an opening through the cover. The pivoting lid is connected with the cover, positioned in the opening in the cover, and pivotable about a pivot axis. The lid gasket connects with the pivoting lid and seals against the cover on opposite sides of the pivot axis when the pivoting lid is in a closed position.

DETAILED DESCRIPTION

Figure 1:
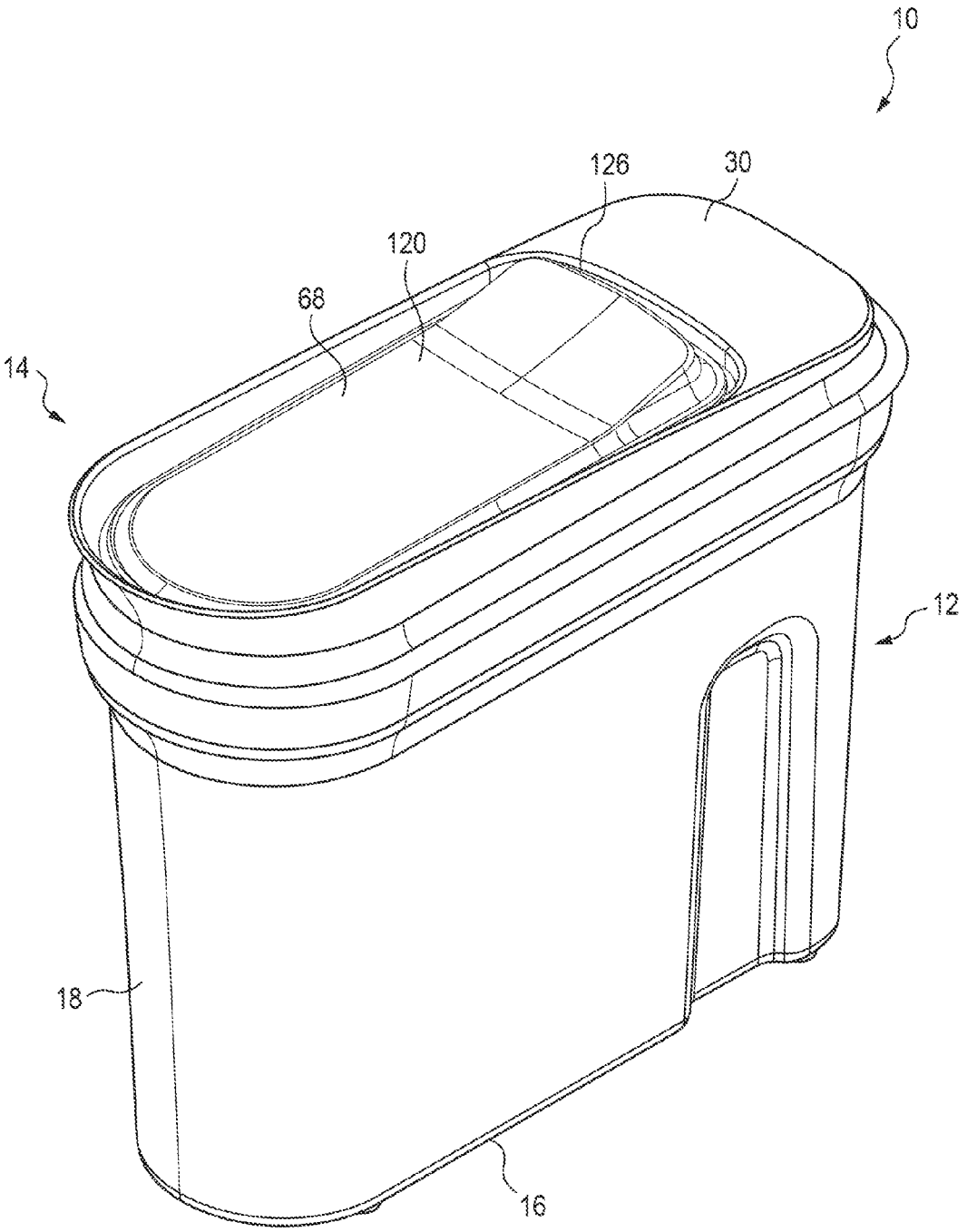
FIG. 1 is a perspective view of a container lid assembly fit on to a container to cover an upper opening of the container.
Figure 2:
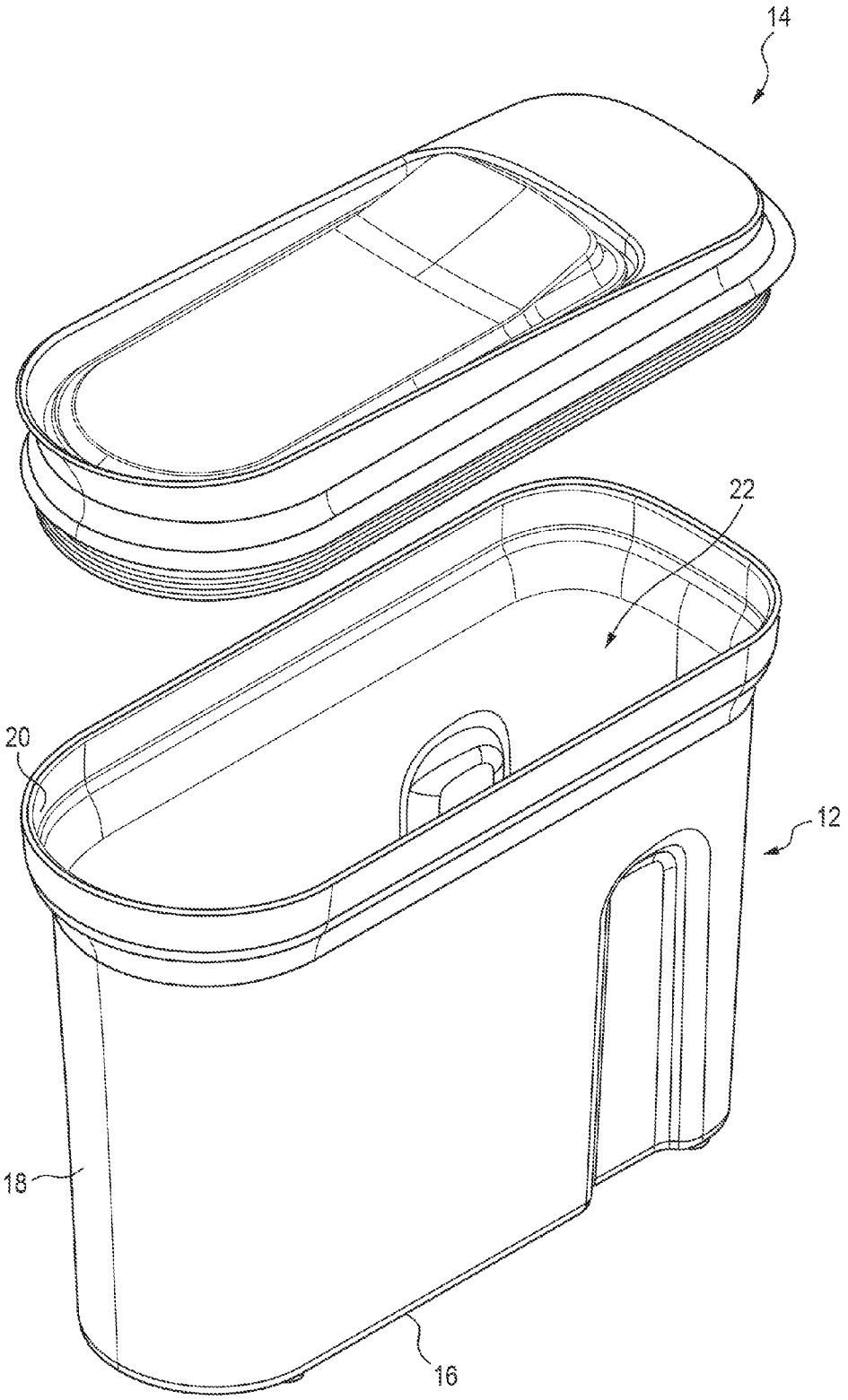
FIG. 2 is a perspective view of the container assembly shown in FIG. 1 with the container lid assembly removed from the container.

FIG. 1 depicts a container assembly 10 including a container 12 and a container lid assembly 14. With reference to FIG. 2, the container 10 includes a bottom wall 16 and a container sidewall 18 extending upwardly from the bottom wall, which define a compartment 22 in which items can be stored. The container 12 also includes an upper opening 20, and the container lid assembly 14 contacts the container sidewall 18 and covers the upper opening 20.

Figure 3:
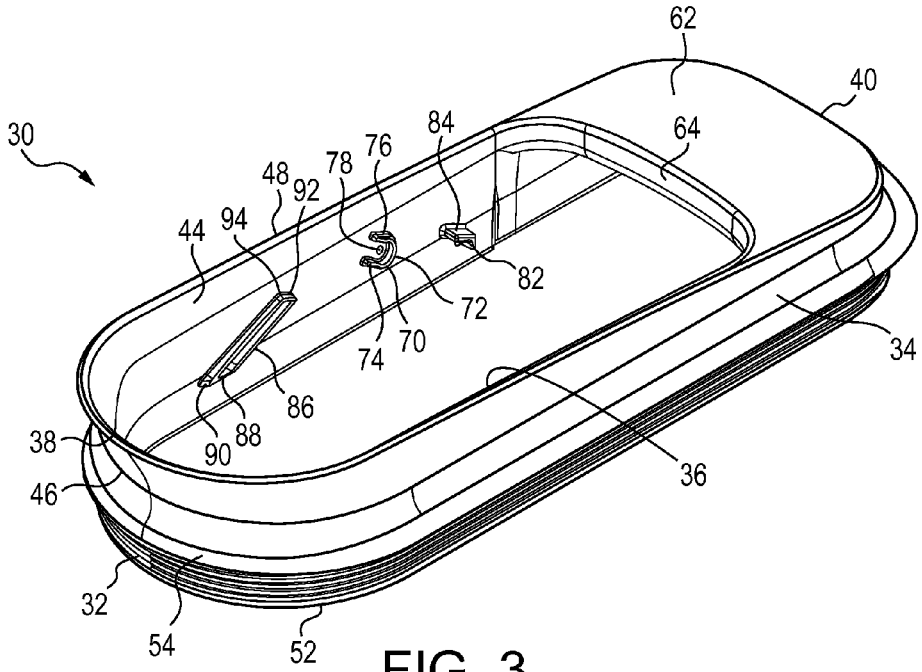
FIG. 3 is a perspective view of a cover of the container lid assembly depicted in FIG. 1.

FIG. 3 depicts a cover 30 of the container lid assembly 14 (FIG. 1). The cover 30 is configured to fit the container 12 to at least partially cover the upper opening 20 (FIG. 2) of the container. A cover gasket 32 surrounds the cover to provide a seal between the cover 30 and the sidewall 18 of the container 12 (FIG. 2).

The cover 30 includes a peripheral sidewall 34 at least partially defining an opening 36 through the cover 30. The cover 30 also includes what will be referred to as a forward end 38 and a rear end 40. The terms "forward" and "rear" are used for ease of understanding of the figures depicted and with reference to how the container assembly 10 can be used; however, these directional terms are not meant to limit the container lid assembly 14 to any particular configuration unless specifically stated as such.

Figure 4:
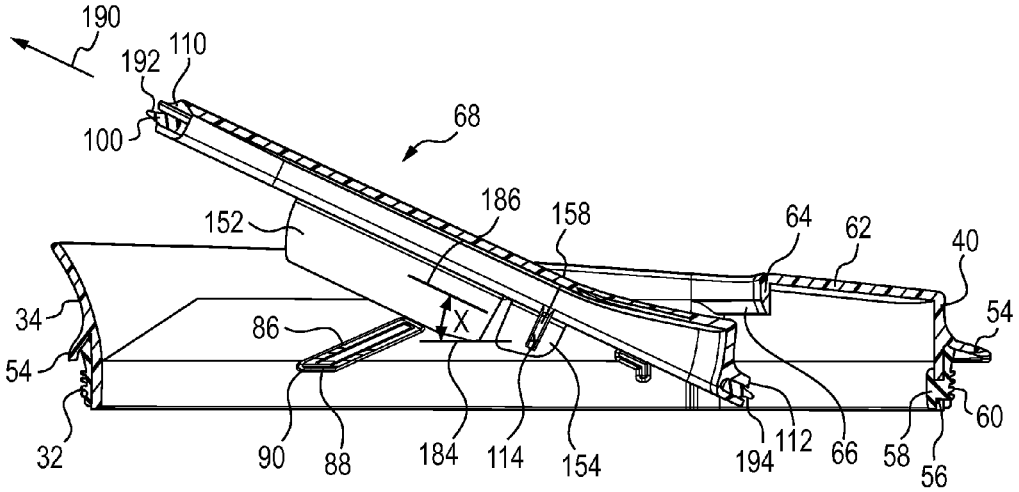
FIG. 4 is a cross-sectional view of the container lid assembly depicted in FIG. 1 with a pivoting lid shown in an open position.

The peripheral sidewall 34 is generally vertically oriented as more clearly seen in FIG. 4. The peripheral wall 34 is obround in plan view, but the shape of the peripheral wall can change based on the shape of the upper opening 20 of the container 12 to which the container lid assembly 14 attaches. The peripheral wall 34 defines an interior surface 44 and an exterior surface 46. The peripheral wall 34 surrounds the cover 30 and is continuous in the illustrated embodiment. The cover 30 also includes an upper edge 48 and a lower edge 52. As more clearly seen in FIG. 4, the peripheral wall 34 along the forward end 38 of the cover 30 curves outwardly toward the upper edge 48 of the peripheral wall 34. The shape of the peripheral wall 34 in the area of the forward end 38 of the cover 30 can aid in the pouring of contents from the container assembly 10. For example, where the container assembly 10 stores cereal, the outwardly curved section of the peripheral wall 34 along the forward end 38 can facilitate pouring cereal from the container 12 through the opening 36 in the cover 30.

The cover 30 also includes a flange 54 that surrounds and extends outwardly from the peripheral wall 34. The shape of the flange 54 can change around the cover. For example, the shape of the flange 54 at the forward end 38 of the cover 30 differs from the shape of the flange 54 at the rear end 40 of the cover. The flange 54 covers the cover gasket 32 that is connected with the cover 30. As more clearly seen in FIG. 4, the peripheral sidewall 34 can also include a hole 56 to facilitate attachment of the cover gasket 32 to the cover 30. The cover gasket 32 includes an integrally formed tab 58 that is received in the hole 56 to connect the cover gasket with the cover 30. The cover gasket 32 also includes upwardly angled fins 60. The upward angle of the fins 60 facilitates attachment of the cover 30 with the container 12 when the cover is pressed downwardly onto the container. The flange 54 can contact the container 12 when container lid assembly 14 is positioned on the container.

The cover 30 also includes an upper wall 62 that is generally horizontally disposed as compared to the peripheral sidewall 32. The upper wall 62 also at least partially defines the opening 36 in the cover 30. The upper wall 62 extends forwardly from the peripheral wall 34 along the rear end 40. An internal wall 64, which is generally vertically oriented, depends downwardly from the upper wall 62 and defines a rear boundary of the opening 36 in the cover 30. The internal wall 64 curves downwardly and rearwardly towards the rear end 40 of the cover 30 to define a rear sealing surface 66, which will be described in more detail below.

The cover 30 also includes components that cooperate with a pivoting lid 68 of the container lid assembly 14. These components are shown in FIG. 3 on one side of the cover 30. In the illustrated embodiment and although not visible in FIG. 3, each component that will be described below is also be found on the opposite side of the cover 30. Each component that is not visible in FIG. 3 is located on the opposite side of the cover 30 and positioned in the same location as its counterpart with respect to the front end 38 and rear end 40 of the cover.

The cover 30 includes guide walls 70 (only one of which is visible in FIG. 3). Each guide wall is U-shaped in the illustrated embodiment, extending inwardly from the internal surface 44 of the peripheral wall 34. Each U-shaped guide wall 70 includes a curved section 72, a lower straight section 74, and an upper straight section 76. The cover 30 also includes a detents 78 (only one of which is visible in FIG. 3). Each respective detent 78 is offset a constant radius from the curved section 72 of the respective U-shaped guide wall 70.

The cover 30 also includes a stop elements 82 (only one of which is visible in FIG. 3). Each stop element 82 extends inwardly from the internal surface 44 of the sidewall 34. Each stop element 82 defines a contact surface 84, which is generally parallel with the straight sections 74, 76 of the U-shaped guide wall 70. Each stop element 82 is disposed rearwardly from the respective U-shaped guide wall 70 and the respective detent 78. The contact surface 84 on each stop element 82 is disposed beneath the detent 78 in a vertical direction.

The cover 30 also includes a catch elements 86 (only one of which is visible in FIG. 3). Each catch element 86 extends inwardly from the internal surface 44 of the peripheral wall 34. Each catch element 86 is disposed forwardly from the U-shaped guide wall 70 and the detent 78. The detent 78 and the U-shaped guide wall 70 are disposed between a catch element 86 and the stop element 82. Each catch element 86 defines a catch surface 88 at a lower end 90 and a travel limit surface 92 at an upper end 94. Each U-shaped guide wall 70, detent 78, stop element 82, and catch element 86 cooperate with the pivoting lid 68 connected with the cover 30 and positioned in the opening 36 in the cover 30.

Figure 5:
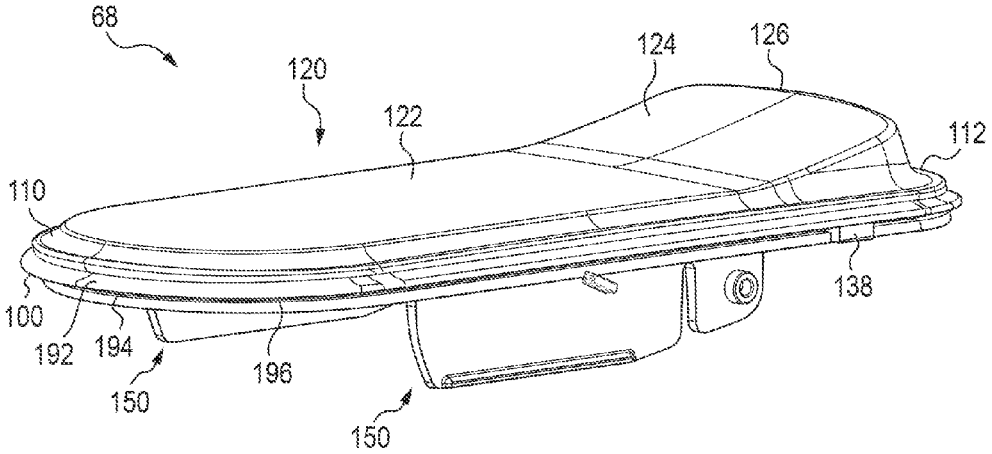
FIG. 5 is a perspective view of the pivoting lid of the container lid assembly depicted in FIG. 1 with a gasket connected with the pivoting lid.

The container lid assembly includes the cover 30, the pivoting lid 68 connected with the cover 30 and positioned in the opening 36 in the cover 30, and a lid gasket 100 connected with the pivoting lid. The pivoting lid 68 is movable between an open position, which is shown in FIG. 4, and a closed position, which is shown in FIG. 1. The container lid assembly 14 can be "open," meaning that contents can be poured from the container 12, when the pivoting lid 68 is in positions between the closed position and the open position shown in FIG. 4. With reference to FIG. 5, the lid 68 in the illustrated embodiment is formed as one piece of plastic that includes a forward end 110 and a rear end 112. The pivoting lid 68 pivots about a pivot axis 114 disposed between the forward end 110 and the rear end 112.

The pivoting lid 68 includes a top wall 120 that at least substantially covers the opening 36 in the cover 30 when the pivoting lid is in the closed position (see FIG. 1). With reference to FIG. 5, the top wall 120 includes a lower section 122, which is generally flat, planar and horizontally oriented. The top wall 120 also includes a ramped section 124 that is disposed rearwardly from the lower section 122. The ramped section 124 angles upwardly and rearwardly from the lower section 122 to define an upper edge 126 of the ramped section 124. The upper edge 126 of the ramped section 124 is disposed vertically higher than the upper wall 62 when the pivoting lid is in the closed position such as that shown in FIGS. 1 and 2. This can provide the operator a visual indication as to where to press to open the pivoting lid 68. In the illustrated embodiment, the ramped section 124 is nearer the rear end 112 as compared to the forward end 110, and the pivoting lid 68 is configured to pivot towards the open position (shown in FIG. 4) when a downward force (per the orientation shown in the FIGS.) is applied to the ramped section 124.

Figure 6:
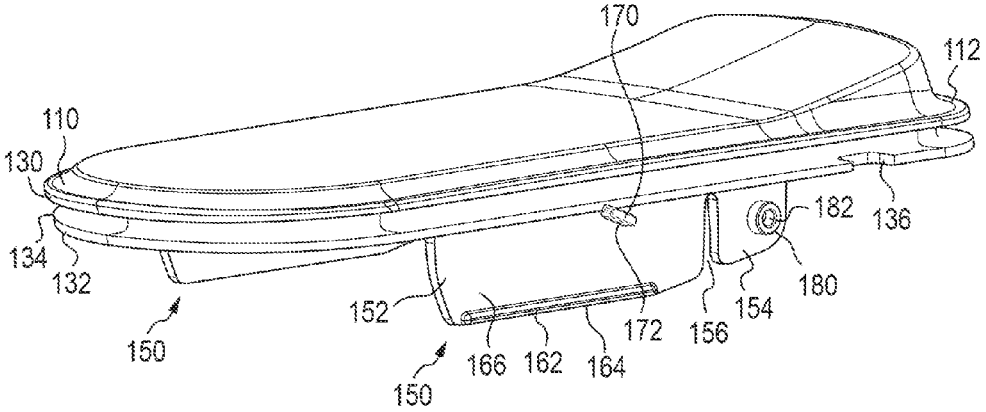
FIG. 6 is a perspective view of the pivoting lid similar to FIG. 5, but without the gasket attached to the pivoting lid.

The pivoting lid 68 also includes an upper ridge 130 and a lower ridge 132, which surround the pivoting lid 68. The upper ridge 130 and the lower ridge 132 define a channel 134, and the lid gasket 100 is received in this channel. In the illustrated embodiment, the lower ridge 132 includes a cutout 136 to facilitate attachment of the lid gasket 100 to the pivoting lid 68. Although not visible in FIGS. 5 and 6, another cutout 136 can be provided on an opposite side of the pivoting lid 68 in a similar location with respect to the front end 110 and the rear end 112 of the pivoting lid 68. The lid gasket 100 includes bumps 138 that are received in the cutouts 136 to facilitate attachment of the gasket 100 with the pivoting lid 68. The bumps 138 are thickened regions of the gasket 100, which will be described in more detail below.

The lid 68 also includes side flanges 150 on each side of the lid. Only a portion of one of the side flanges 150 is visible in FIGS. 5 and 6, however, each side flange is similar in configuration. As such, only one side flange will be described with particularity with the understanding that the opposite side flange has the same construction.

The side flange 150 extends downwardly from the lower ridge 132 and is generally vertically oriented. The side flange includes a forward section 152 and a rear section 154 separated by a cutout 156. The forward section 152 is more flexible than the rear section 154 and is designed to flex inwardly and cooperate with the catch element 86 on the cover 30. With reference to FIG. 4, the rear section 154 of the side flange 150 is provided with a strut 158 that extends inwardly and provides rigidity to the rear section 154.

With reference back to FIGS. 5 and 6, the lid 68 includes an elongate protuberance 162 near a lower edge 164 of the forward section 152 that operates as a detent. The elongate protuberance 162 extends in a direction that is generally parallel with the channel 134 and the lid gasket 100 received in the channel 134. The elongate protuberance 162 cooperates with the catch surface 88 on the catch element 86 to retain the pivoting lid in the closed position. When the pivoting lid 68 is in the closed position, the elongate protuberance 162 contacts the catch surface 88. When moving from the open position (shown in FIG. 4) toward the closed position, the elongate protuberance 162 rides along the catch element 86 and the forward section 152 flexes inwardly until the elongate protuberance 162 rides over the catch element and engages the catch surface 88 at which time the forward section 152 flexes back outwardly.

The pivoting lid 68 also includes a lid stop 170, which extends outwardly from the outer surface 166 of the forward section 152. The lid stop 170 is generally block-shaped and defines a contact surface 172. The contact surface 172 is on a lower side of the lid stop 170 and is angled with respect to the horizontal. The lid stop 170 is configured to cooperate with the cover 30 to prevent further movement of the pivoting lid 68 in a closing rotational direction beyond the closed position shown in FIG. 1. When the pivoting lid 68 is in the closed position, the contact surface 172 of the lid stop 170 contacts the travel limit surface 92 at the upper end 94 of the catch element 86. This contact precludes the further movement of the pivoting lid 68 in the closing rotational direction beyond the closed position.

The pivoting lid 68 also includes a boss 180 on the side flange 150 positioned nearer the rear end 112 of the pivoting lid 68 as compared to the lid stop 170 and the elongate protuberance 162, which operates as a detent. In the illustrated embodiment, the boss is located on the rear section 154 of the side flange 150. As discussed above, the side flange 150 includes the cutout 156 and the boss 180 is positioned on one side of the cutout 156 and the lid stop 170 and the elongate protuberance 162, which operates as a detent, are positioned on an opposite side of the cutout 156. The boss 180 is coaxial with the pivot axis 114 of the pivoting lid 68. Each boss 180 is receivable in and releasable from a respective U-shaped guide wall 70 on the cover 30. The boss 180 is properly aligned with respect to the U-shaped guide wall 70 when an opening 182 defined by the boss receives the detent 78 disposed inside the guide wall 70.

The pivoting lid 68 is slidably removable from the cover 30. To slidably remove the pivoting lid 68 from the cover 30, the pivoting lid 68 is moved to the open position shown in FIG. 4. The cover 30 and the pivoting lid 68 are configured such that removal of the pivoting lid from the cover is inhibited when the pivoting lid is in the closed position, which is shown in FIG. 1. The cover 30 and the pivoting lid 68 can be configured such that removal of the pivoting lid from the cover is inhibited when the pivoting lid is in any position other than the open position shown in FIG. 4. With reference to FIG. 4, the pivoting lid pivots x degrees from a first line 184 to a second line 186 when pivoting from the closed position (see FIG. 1) to the open position shown in FIG. 4. The pivoting lid 68 is slidably removable from the cover 30 when the pivoting lid is moved in a direction coincident or parallel with the second line 186 (see arrow 190).

The U-shaped guide walls 70 and the cover 30 are oriented such that the pivoting lid 68 is removable from each U-shaped guide wall 70 when the pivoting lid is pulled in a direction coincident or parallel with the second line 186. The U-shaped guide wall 70 is aligned such that the straight leg sections 74, 76 are angled so as to be parallel with the arrow 190, which is parallel with the plane in which the lower section 122 of the top wall 120 resides when the pivoting lid 68 is in the open position. This allows for easy removal of the pivoting lid 68 from the cover 30. When the pivoting lid 68, however, is in positions other than the open position shown in FIG. 4, pulling the lid in that same direction would result in the boss 180 contacting the lower straight section 74 of the U-shaped guide wall 70, which would inhibit removal of the pivoting lid 68 from the cover 30.

An operator can replace the lid 68 after it has been removed from the cover 30 by orienting the pivoting lid 68 in a manner similar to that shown in FIG. 4 and moving the pivoting lid in a translational direction opposite the arrow 190 with respect to the cover 30. With the pivoting lid 68 connected with the cover 30, the detent 78 on the cover cooperates with the boss 180 on the pivoting lid 68 to inhibit translational movement of the pivoting lid with respect to the cover 30 while permitting rotational movement of the pivoting lid 68 with respect to the cover 30 about the pivot axis 114.

The lid gasket 100 is connected with the pivoting lid 68. The lid gasket 100 is generally ring-shaped and follows the shape of the channel 134 formed in the pivoting lid 68. The lid gasket defines an upper surface 192 and a lower surface 194. Both the upper surface 192 and the lower surface 194 contact the cover 30 when the pivoting lid is in the closed position. The upper surface 192 of the lid gasket 100 positioned along the rear end 112 of the pivoting lid 68 contacts the cover 30 when the pivoting lid 68 is in the closed position. More particularly, the upper surface 192 of the lid gasket 100 positioned along the rear end 112 contacts the rear sealing surface 66 of the internal wall 64, which defines a rear boundary of the opening 36 in the cover 30. The lower surface 194 of the lid gasket 100 positioned along the forward end 110 of the pivoting lid 68 contacts the cover 30 when the pivoting lid 68 is in the closed position. The lower surface 194 of the lid gasket 100 contacts the interior surface 44 of the peripheral wall 34 along the forward end 38 of the cover 30 where the peripheral wall 34 curves outwardly toward the upper edge 48. The lid gasket 100 can also include a peripheral edge 196 that interconnects the upper surface 192 to the lower surface 194. The peripheral edge 196 of the lid gasket 100 contacts the interior surface 44 of the peripheral wall 34 between the forward end 38 of the cover to the internal wall 64 when the pivoting lid is in the closed position 68. As such, the lid gasket 100 can operate as a seal between the pivoting lid 68 and the cover 30 when the pivoting lid 68 is in the closed position.

The lid gasket 100 is shown as a flat gasket in the figures. The lid gasket 100 can take other configurations, for example a hollow compressible seal or foam type gasket. Such a lid gasket 100 could still seal against the cover 30 on opposite sides of the pivot axis 114 when the pivoting lid 68 is in the closed position.

A container assembly including a container lid assembly has been described above with particularity. Modifications and alterations will occur to those upon reading and understanding the preceding detailed description. The invention, however, is not limited to only the embodiments described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A container lid assembly comprising:

a cover configured to fit with an associated container and defining an opening through the cover;

a pivoting lid connected with the cover and positioned in the opening in the cover, the pivoting lid being movable between an open position and a closed position, wherein the pivoting lid includes a forward end and a rear end, and the pivoting lid pivots about a pivot axis disposed between the forward end and the rear end; and a lid gasket connected with and surrounding the pivoting lid, the lid gasket defining an upper surface and a lower surface, wherein the upper surface and the lower surface contact the cover when the pivoting lid is in the closed position.

2. The container lid assembly of claim 1, wherein the gasket is a flat ring-shaped gasket that extends outwardly from the pivoting lid.

3. The container lid assembly of claim 1, wherein the pivoting lid includes a ramped section nearer to the rear end as compared to the forward end and the pivoting lid being configured to pivot towards the open position when a downward force is applied to the ramped section.

4. The container lid assembly of claim 3, wherein the cover includes an upper wall at least partially defining the opening in the cover, wherein an upper edge of the ramped section is disposed vertically higher than the upper wall when the pivoting lid is in the closed position.

5. The container lid assembly of claim 1, the pivoting lid being configured to pivot towards the open position when a downward force is applied to the pivoting lid adjacent the rear end, wherein the upper surface of the lid gasket positioned along the rear end of the pivoting lid contacts the cover when the pivoting lid is in the closed position, wherein the lower surface of the lid gasket positioned along the forward end of the pivoting lid contacts the cover when the pivoting lid is in the closed position.

6. The container lid assembly of claim 1, wherein the pivoting lid includes a generally vertically extending side flange, a detent on the side flange and a lid stop on the side flange, wherein the detent is configured to cooperate with the cover to resist movement towards the open position when the pivoting lid is in the closed position, wherein the lid stop is configured to cooperate with the cover to prevent further movement of the pivoting lid in a closing rotational direction beyond the closed position.

7. The container lid assembly of claim 6, wherein the pivoting lid includes a boss on the side flange positioned nearer a rear end of the pivoting lid as compared to the lid stop and the detent, wherein the boss is coaxial with a pivot axis of the pivoting lid, wherein the side flange includes a cut out and the boss is positioned on one side of the cut out and the lid stop and the detent are positioned on an opposite side of the cut out.

8. The container lid assembly of claim 1, wherein at least one of the pivoting lid and the gasket includes a lid stopper configured to cooperate with the cover to prevent movement of the pivoting lid in an opening rotational direction beyond the open position.

9. The container lid assembly of claim 1, wherein the pivoting lid is slidably removable from the cover when the pivoting lid is in the open position.

10. A container lid assembly comprising:

a cover configured to fit with an associated container and defining an opening through the cover, wherein the cover includes a peripheral wall at least partially defining the opening and a U-shaped guide wall extending inwardly from the peripheral wall; and a pivoting lid releasably connected with the cover and positioned in the opening in the cover, the pivoting lid being movable between an open position and a closed position, wherein the pivoting lid includes a forward end and a rear end, and the pivoting lid pivots about a pivot axis disposed between the forward end and the rear end, wherein the pivoting lid is slidably removable from the cover when the pivoting lid is in the open position, wherein the pivoting lid pivots x degrees from a first line to a second line when pivoting from the closed position to the open position, and the pivoting lid includes a boss receivable in and releasable from the U-shaped guide wall, wherein the U-shaped guide wall is oriented such that the pivoting lid is slidably removable from the U-shaped guide wall when pulled in a direction coincident or parallel with the second line, wherein the rear end of the pivoting lid moves downwardly further into the opening when the pivoting lid is moving from the closed position toward the open position.

11. The container lid assembly of claim 10, wherein the cover and the pivoting lid are configured such that removal of the pivoting lid from the cover is inhibited when the pivoting lid is in the closed position.

12. The container lid assembly of claim 10, wherein the cover and the pivoting lid are configured such that removal of the pivoting lid from the cover is inhibited when the pivoting lid is in any position other than the open position.

13. The container lid assembly of claim 10, wherein the cover includes a detent that cooperates with the boss to inhibit translational movement of the pivoting lid with respect to the cover while permitting rotational movement of the pivoting lid with respect to the cover.

14. The container lid assembly of claim 10, further comprising a lid gasket connected with the pivoting lid, wherein the cover includes a stop element extending inwardly from the peripheral wall and at least one of the pivoting lid and the lid gasket contacts the stop element when the pivoting lid is in the open position.

15. The container lid assembly of claim 14, wherein the stop element defines a contact surface that is parallel with each straight-leg section of the U-shaped guide wall.

16. The container lid assembly of claim 15, wherein the cover includes a catch element extending inwardly from the peripheral wall and the pivoting lid includes a detent that cooperates with the catch element to inhibit movement towards the open position when the pivoting lid is in the closed position.

17. The container lid assembly of claim 16, wherein the cover includes a travel limit surface extending inwardly from the peripheral wall and the pivoting lid includes a lid stop that cooperates with the travel limit surface to inhibit movement towards a closing direction beyond the closed position.

18. The container lid assembly of claim 16, wherein the catch element defines a catch surface and the detent is an elongate protuberance that engages the catch surface, and the catch surface and the travel limit surface are each defined by the catch element.

19. A container lid assembly comprising:

a cover configured to fit with an associated container and including a peripheral wall, which is generally vertically oriented, at least partially defining an opening through the cover;

a pivoting lid connected with the cover, positioned in the opening in the cover, and pivotable about a pivot axis within the opening; and a lid gasket connected with the pivoting lid, the lid gasket sealing against the cover on opposite sides of a vertical plane when the pivoting lid is in a closed position, wherein the pivot axis is disposed along the vertical plane.

20. The container lid assembly of claim 19, wherein the peripheral wall along a forward end of the cover curves outwardly toward an upper edge of the peripheral wall and the cover includes an internal wall depending downwardly from an upper wall and defining a rear boundary of the opening in the cover, wherein the internal wall curves downwardly and rearwardly towards a rear end of the cover.

21. A container lid assembly comprising:

a cover configured to fit with an associated container and defining an opening through the cover;

a pivoting lid connected with the cover and positioned in the opening in the cover, the pivoting lid pivoting about a pivot axis within the opening between an open position and a closed position, wherein the pivoting lid includes a forward end and a rear end and the pivot axis is disposed between the forward end and the rear end; and a lid gasket connected with the pivoting lid, the lid gasket defining an upper surface and a lower surface, wherein the upper surface of the lid gasket positioned along the rear end of the pivoting lid contacts the cover when the pivoting lid is in the closed position, and the lower surface of the lid gasket positioned along the forward end of the pivoting lid contacts the cover when the pivoting lid is in the closed position.

22. A container lid assembly comprising:

a cover configured to fit with an associated container and defining an opening through the cover;

a pivoting lid connected with the cover and positioned in the opening in the cover, the pivoting lid being movable between an open position and a closed position, wherein the pivoting lid includes a forward end and a rear end, and the pivoting lid pivots about a pivot axis disposed between the forward end and the rear end, wherein the rear end moves downwardly further into the opening when the pivoting lid is moving from the closed position toward the open position; and a lid gasket connected with the pivoting lid, wherein the lid gasket positioned along the rear end of the pivoting lid contacts the cover when the pivoting lid is in the closed position, and the lid gasket positioned along the forward end of the pivoting lid contacts the cover when the pivoting lid is in the closed position.

* * * * *